US005147037A

United States Patent [19]

Evers et al.

[11] Patent Number: 5,147,037

[45] Date of Patent: Sep. 15, 1992

[54] CARTON PROVIDING EASY ACCESS TO PACKAGED GOODS CONTAINED THEREIN

[75] Inventors: Donald H. Evers, Richmond; William C. Harris, Jr., Midlothian; Robert E. Talley, Chester, all of Va.

[73] Assignee: Philip Morris Incorporated, New York, N.Y.

[21] Appl. No.: 827,113

[22] Filed: Jan. 28, 1992

Related U.S. Application Data

[63] Continuation-in-part of Ser. No. 774,529, Oct. 8, 1991.

[51] Int. Cl.[5] ..... B65D 85/10; B65D 25/00

[52] U.S. Cl. ..... 206/256; 206/264; 206/813; 206/45.31; 206/273; 206/459; 206/459.5; 229/120.011

[58] Field of Search ..... 206/45.31, 45.33, 256, 206/264, 813, 273; 229/120.11

[56] References Cited

U.S. PATENT DOCUMENTS

| | | | |
|---|---|---|---|
| 2,072,695 | 3/1937 | Wellman | 206/45.31 |
| 2,109,583 | 3/1938 | Bennett | 206/813 |
| 2,129,701 | 9/1938 | Malocsay | 206/45.31 |
| 2,205,437 | 6/1940 | Ringler . | |
| 2,548,985 | 4/1951 | Lighter | 206/45.31 |
| 2,565,509 | 8/1951 | Marcin | 206/813 |
| 2,605,897 | 8/1952 | Rundle | 206/264 |
| 2,729,326 | 1/1956 | Stadnyk | 206/45.31 |
| 2,895,601 | 7/1959 | Krukonis | 206/45.31 |
| 3,051,305 | 8/1962 | Houle | 206/264 |
| 3,063,553 | 11/1962 | Nicholson | 206/45.31 |
| 3,071,244 | 1/1963 | Doran | 206/45.31 |
| 3,113,673 | 12/1963 | Stein . | |
| 3,144,190 | 8/1964 | Holt | 229/27 |
| 3,392,501 | 7/1968 | Gilchrist | 206/45.31 |
| 3,447,733 | 6/1969 | Smith et al. | 229/120.011 |
| 3,503,568 | 3/1970 | Galley | 242/74 |
| 3,596,758 | 8/1971 | Phillips, Jr. et al. | 206/45.31 X |
| 3,638,853 | 2/1972 | Perry | 229/132 |
| 3,759,378 | 9/1973 | Werth | 206/429 |
| 3,809,227 | 5/1974 | Begemann | 206/264 |
| 4,186,835 | 2/1980 | Hofer | 206/443 |
| 4,424,658 | 1/1984 | Yocke | 53/443 X |
| 4,441,611 | 4/1984 | Sommariva | 206/813 |
| 4,485,926 | 12/1984 | Lenzmeier . | |
| 4,631,900 | 12/1986 | Mattei et al. | 53/448 |
| 4,669,611 | 6/1987 | Flaherty | 206/442 |
| 4,738,359 | 4/1988 | Phillips, Jr. | 206/256 |
| 4,928,817 | 5/1990 | Focke | 206/256 |
| 4,932,534 | 6/1990 | Focke et al. | 206/273 X |

FOREIGN PATENT DOCUMENTS

| | | | |
|---|---|---|---|
| 2507765 | 9/1976 | Fed. Rep. of Germany | 206/45.31 |
| 358560 | 10/1931 | United Kingdom . | |

*Primary Examiner*—William I. Price

*Attorney, Agent, or Firm*—Jeffrey H. Ingerman; Karen G. Horowitz

[57] ABSTRACT

A cigarette carton providing pull tabs which allow for convenient opening of the carton and later convenient access to cigarette packs contained within the carton. Windows for conveniently accessing cigarette packs contained within the carton during tax-stamping such that the cartons do not need to be opened for tax-stamping are also shown. The carton may be dimensioned to contain five cigarette packs and joined to a similar carton to form a dual carton which can be passed through tax-stamping machinery.

68 Claims, 10 Drawing Sheets

CARTON PROVIDING EASY ACCESS TO PACKAGED GOODS CONTAINED THEREIN

CROSS REFERENCE TO RELATED APPLICATION

This application is a continuation-in-part of copending, commonly-assigned U.S. patent application Ser. No. 07/774,529, filed Oct. 8, 1991, which is hereby incorporated by reference in its entirety.

BACKGROUND OF THE INVENTION

The present invention relates to cigarette cartons, and more particularly, to cartons which allow for easy access to the cigarette packs contained therein.

Cigarette packs (which usually contain twenty cigarettes) are generally rectangular in shape, having front and back long walls connected by two short side walls. Cigarette packs are typically packaged by the manufacturer in cigarette cartons, and are arranged so that the front long walls of the packs are in the same plane and the back long walls are in a parallel plane spaced from the plane of the front long walls. The filled cartons are usually temporarily closed and shipped to various distributors. The distributors generally open the cartons to apply the tax stamp that may be required by the jurisdiction in which they operate to an end of each cigarette pack while the packs are still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for ten-pack cartons, i.e., cartons containing two rows of five cigarette packs per row. A typical tax-stamping machine is model FUSON manufactured by Meyercord of 365 East North Avenue, Carol Stream, Ill. 60187.

Single row cigarette cartons which are dimensioned to contain one row of five cigarette packs (five columns of cigarette packs), i.e., five-pack cartons, are also known in the art. However, although machinery exists for manufacturing such cartons, machinery does not exist for stamping the cigarette packs contained in such cartons. Consequently, such single row cartons must either be hand-stamped (as is done currently) or would have to be secured together in pairs in order to be run through the existent commercially available tax-stamping equipment in which double row cartons are stamped. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

Although single row cartons may be sufficiently secured together such that they may be passed through commercially available tax-stamping equipment, other problems which occur during tax-stamping must be addressed. One major disadvantage of using commercially available tax-stamping equipment for processing cartons for which the equipment was not designed is that the equipment usually does not adequately handle cartons having top flap configurations different than flap configurations on cartons ordinarily processed.

Tax-stamping machines generally include equipment which opens the temporarily closed cartons so that the ends of the cigarette packs are accessible for application of a tax stamp. Tax-stamping machines also generally include equipment which closes the cartons after the tax stamp is applied, so that the carton is in condition for distribution to consumers. Commercially available tax-stamping machines, designed for processing ten-pack cartons, often cannot handle the top flaps of five-pack cartons to open and later close the cartons adequately, thus interfering with the tax-stamping process.

Another disadvantage related to the tax-stamping process, in general, is that the process by which the cartons are re-sealed often does not allow for easy access by the consumer to the cigarette packs contained within the cartons.

SUMMARY OF THE INVENTION

It is therefore an object of the invention to provide a means for accessing cigarette packs contained in cigarette cartons so that the appropriate tax stamp may be applied by commercially available tax-stamping equipment.

It is another object of the invention to provide a means for sealing a cigarette carton which allows for easy access by the consumers to the cigarette packs contained therein.

It is a further object of this invention to provide a dual cigarette carton composed of two individual cartons, connected so that they may be passed through a tax-stamping machine without moving relative to one another, but may be later separated for individual sale.

These and other object of the invention are accomplished in accordance with the principles of the invention by providing windows in the wall of a cigarette carton which the bottoms of the cigarette packs contained therein face. The required tax stamp accordingly may be applied without necessarily opening the carton. Because the cartons which have such windows typically remained sealed throughout the tax-stamping process, the manufacturer may utilize a particular means for sealing the carton which will eventually reach the consumer (because the tax-stamping machine will not open the carton and thereby destroy such means). Thus, this invention accomplishes the object of easy consumer access to the cigarette packs by providing means for sealing the cartons which allow for easy, convenient access to the cigarette packs by the consumer.

BRIEF DESCRIPTION OF THE DRAWINGS

Further features of the invention, its nature, and various advantages will be more apparent from the following detailed description of the preferred embodiments and the accompanying drawings, wherein like reference characters represent like elements throughout, and in which.

DETAILED DESCRIPTION OF THE INVENTION

Figure 1:
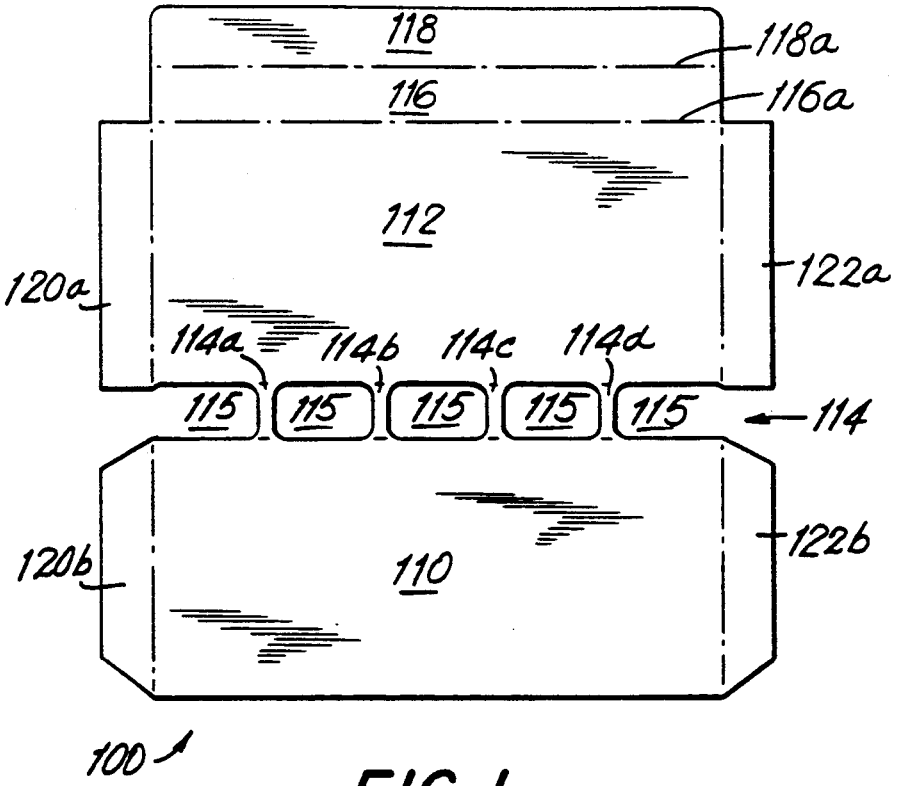
FIG. 1 is a plan view of an illustrative carton blank for a five-pack carton having windows in a wall between the front and rear walls along which the bottoms of cigarette packs to be contained therein are placed.

As shown in FIG. 1, blank 100, from which carton 130 is formed, has two large panels 110 and 112, which form front and rear panels of the carton; panels 120*a*, 120*b*, 122*a*, and 122*b*, which form side panels of the carton; panels 114 and 116, which form bottom and top panels of the carton; and extension panel 118, extending from panel 116. The blank, which is preferably cardboard or paperboard, is folded along a plurality of fold lines, represented by broken lines which are not all individually labeled, to form carton 130. Panel 120*a* and panel 122*a* are folded over panel 120*b* and panel 122*b*, respectively, to form side walls 120 and 122, respectively, of carton 130. Panel 114 has a plurality of window sections 115, with web sections 114*a*, 114*b*, 114*c*, and 114*d* extending between the windows and joining panels 110 and 112. As shown, the blank is dimensioned so that the front and rear panels 110 and 112 are substantially five times the width of the long wall of a cigarette pack to be contained in the completed carton, and the side panels 120 and 122 are substantially the same width of the short wall of a cigarette pack to be contained in the completed carton. As used herein, a cigarette pack is defined as any pack commonly used for holding a predetermined number of cigarettes, and generally having front and back long walls connected by two short side walls. Each window/cut out portion 115 is dimensioned to expose a sufficient area of the bottom of a cigarette pack contained in the completed carton to receive the required portion of a tax stamp, i.e., a large enough portion of a tax stamp to render such stamp valid. Each web/connection strip is wide enough to retain the cigarette packs in the carton so that they do not accidentally fall out of the carton.

Figure 2:
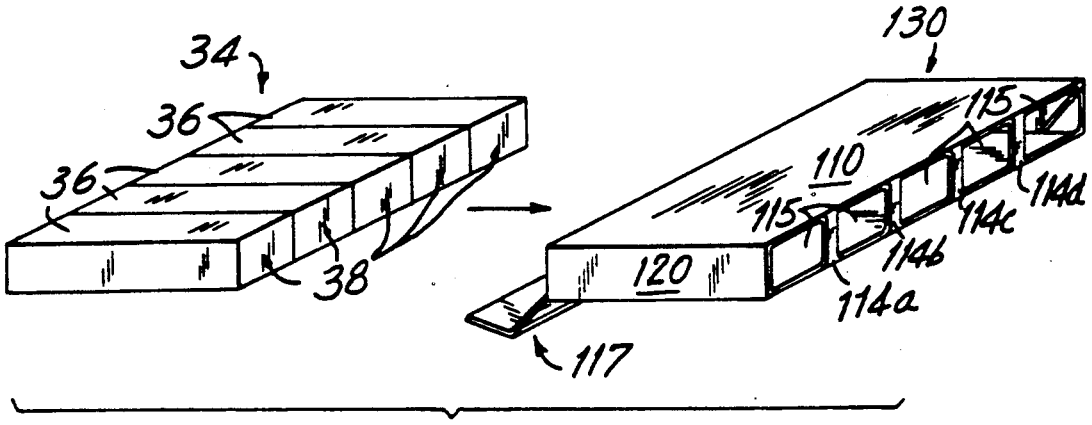
FIG. 2 is an exploded isometric view of a carton constructed from a blank similar to that shown in FIG. 1, illustrated prior to insertion of the cigarette packs into the carton.
Figure 3:
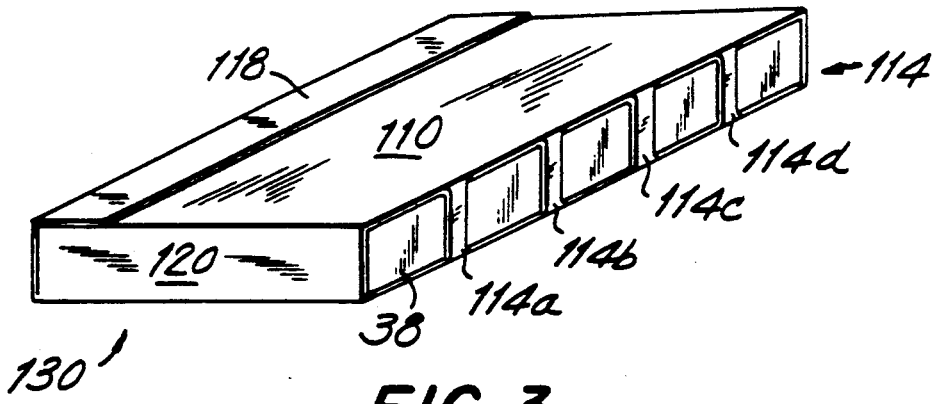
FIG. 3 is an isometric view of a sealed carton constructed from a blank similar to that shown in FIG. 1, and containing cigarette packs.

Carton 130, formed by blank 100, is shown in FIG. 2, prepared for insertion of a bundle 34 of cigarette packs 36. Each pack has a bottom wall 38, which is positioned adjacent a window 115 in panel 114. The filled and sealed carton 130 is shown in FIG. 3, with bottom walls 38 exposed through panel 114, with webs 114*a*, 114*b*, 114*c*, and 114*d* retaining packs 36 in the carton. Extension panel 118 and panel 116 form a top and tuck-in flap 117, which is folded over the top of the carton, and panel 118 is either tucked inside the carton or secured to the outer surface of the carton. Panel 118 is secured to the carton with any known permanent or releasable adhesive to close the carton and to retain the cigarettes within the carton, a particularly important consideration given the inherent weakness of panel 114. The carton may be opened by a consumer by either detaching panel 118 from front wall 110 (particularly when releasable adhesive is used), or by disconnecting webs 114*a*, 114*b*, 114*c*, or 114*d*, as needed, from either or both panels 110, 112. Perforations 110*a*, shown in FIG. 1, may be provided to facilitate disconnection of the webs from the panels which the webs join.

Figure 4:
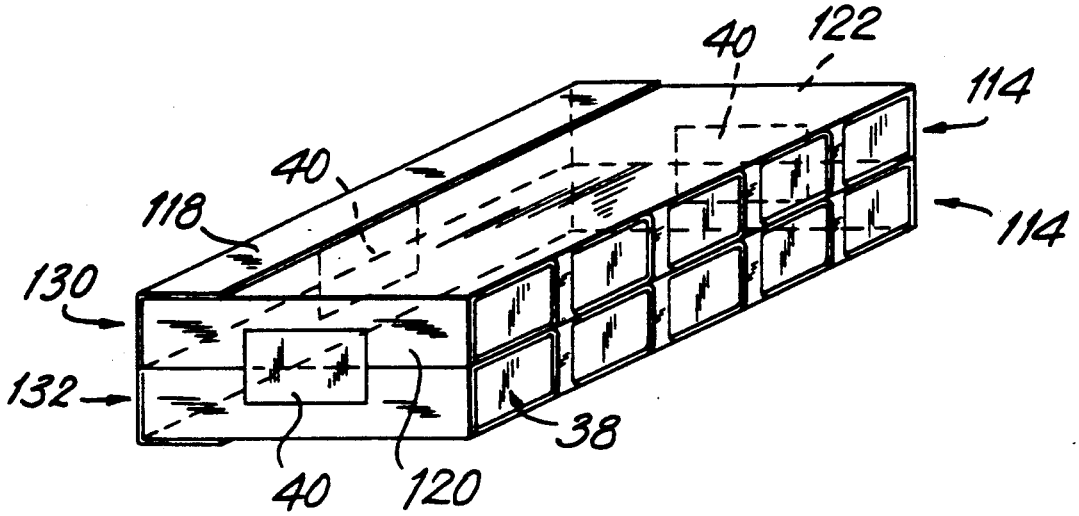
FIG. 4 is an isometric view of two five-pack cartons, each constructed from a blank similar to that shown in FIG. 1, connected together to form, once connected, a ten-pack carton.

As shown in FIG. 4, two cartons 130, 132, each formed by a blank such as blank 100, may be joined, by means such as described in above-incorporated patent application Ser. No. 07/774,529, such as stickers 40, applied across adjacent coplanar walls. One of stickers 40 may bear U.P.C. (Universal Product Code) or other pricing indicia, such as described in copending, commonly-assigned U.S. patent application Ser. No. 07/792,617, filed Nov. 15, 1991, which is hereby incorporated by reference in its entirety. Such a dual carton may be passed through commercially available tax-stamping machinery, adapted to process ten-pack cigarette cartons. Tax-stamping machines are typically designed to open and reseal cartons which have one long flap extending from one long wall of the carton and extending across the top of the carton to the other long wall, and one short flap extending from the opposite long wall of the carton and extending partially across the top of the carton. Because windows 115 allow access to ends 38 of cigarette packs 36, the tax-stamping machine need not open and later reseal cartons 130, 132, and thus does not need to be adjusted to accommodate flaps 117, which are of equal length.

Figure 5:
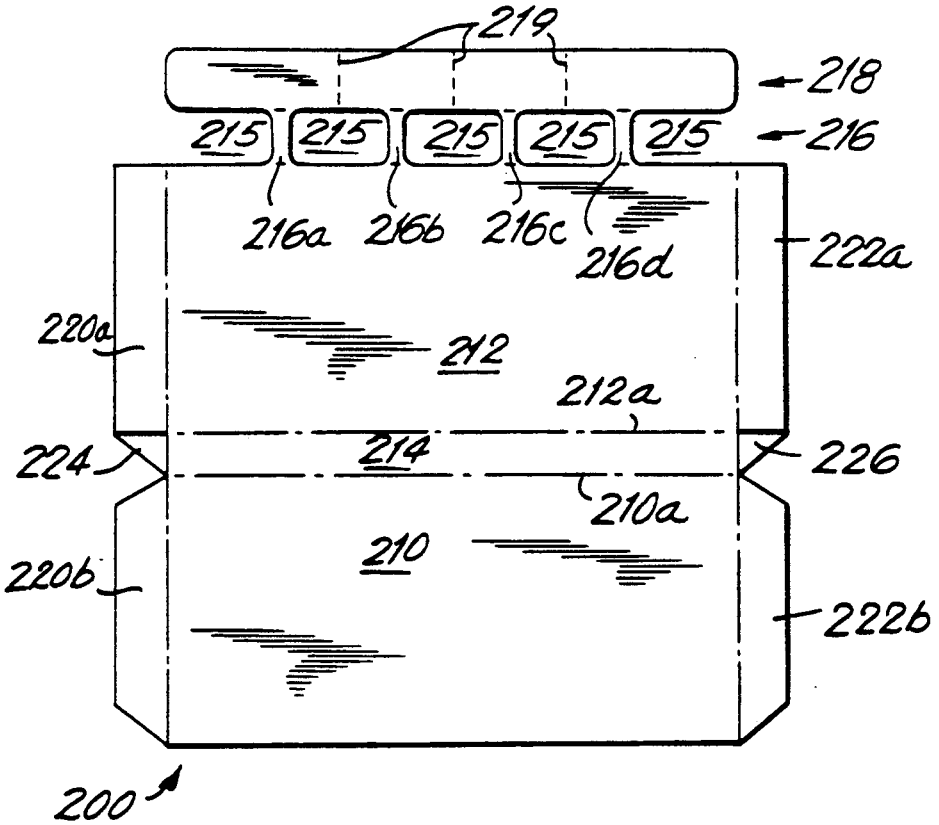
FIG. 5 is a plan view of an illustrative carton blank for a five-pack carton having windows in the covering flap, and perforations in the extension panel, in accordance with this invention.
Figure 6:
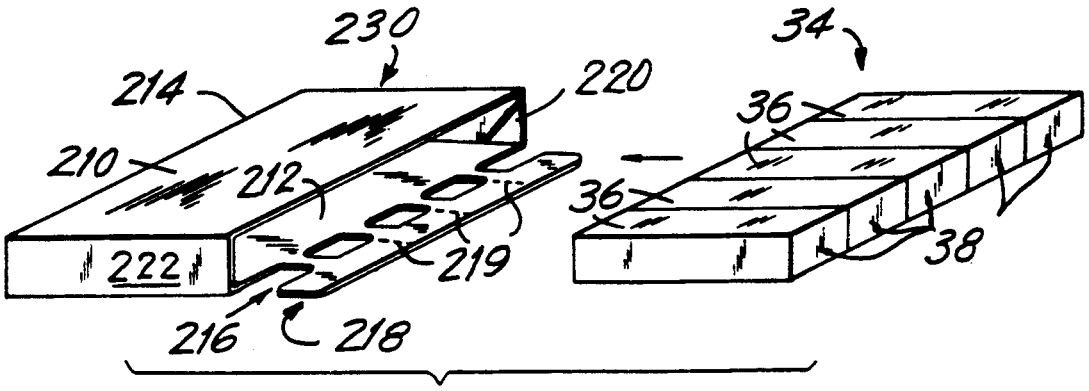
FIG. 6 is an exploded isometric view of a carton constructed from a blank similar to that shown in FIG. 5, illustrated prior to insertion of the cigarette packs into the carton.

Windows may alternatively be provided in the top panel of the blank, as in blank 200, shown in FIG. 5. Similar to blank 100, blank 200 is preferably formed of cardboard or paperboard, and has two large panels 210 and 212, which form front and rear panels of the carton; panels 220*a*, 220*b*, 222*a*, and 222*b*, which form side panels of the carton; panels 214 and 216, which form bottom and top panels of the carton; and extension panel 218, extending from panel 216. The blank is folded along a plurality of fold lines, represented by broken lines which are not all individually labeled, to form carton 230. Panel 220*a* and panel 222*a* are folded over panel 220*b* and panel 222*b*, respectively, to form side walls 220 and 222, respectively, of carton 230. Dust flaps 224 and 226 are preferably folded to be substantially parallel walls 220 and 222, respectively. Panel 216 has a plurality of window sections 215, with web sections/connection strips 216*a*, 216*b*, 216*c*, and 216*d* extending between the windows and joining panels 212 and 218. As shown, the blank is dimensioned so that the front and rear panels 210 and 212 are substantially five times the width of the long wall of a cigarette pack to be contained in the completed carton, and the side panels 220 and 222 are substantially the same width of the short wall of a cigarette pack to be contained in the completed carton so that completed carton 230 is a five-pack carton. Windows 215 and webs 216*a*, 216*b*, 216*c*, and 216*d* are dimensioned such as their counterparts in blank 100. Panel 218 preferably includes perforated lines 219, along which panel 218 may be torn by the consumer to access the cigarettes to be contained within the formed carton. Lines 219 may be positioned between webs 216, such as shown in FIG. 5. Lines 219 alternatively may be positioned between a window 215 and a web 216 so that each line 219 meets a web 216 at the intersection point of web 216, extension panel 218, and window 215, i.e. line 219 is aligned with the edge of window 215, as shown in FIG. 6. The number of lines 219 may be varied, as desired. Preferably, each cut out portion between two connection strips is in communication with a line 219, the position of which line may be varied, as desired.

Figure 7:
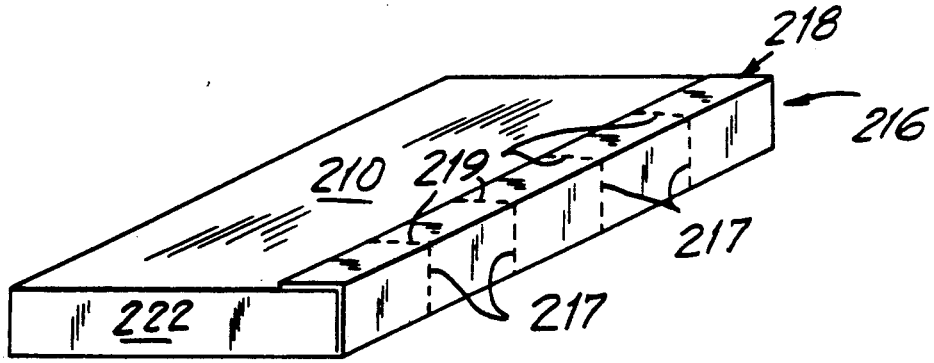
FIG. 7 is an isometric view of a sealed carton constructed from a blank similar to that shown in FIG. 5, and containing cigarette packs.

If desired, such perforated lines as 219 need not cooperate with cut out portions, but may be included in a carton without windows, such as shown in FIG. 7. Perforated lines 217 are preferably provided, aligned with lines 219 to cooperate with lines 219 when windows are not provided. Preferably, the sections defined by lines 219 and 217 are of sufficient width to allow access to one cigarette pack at a time.

Completed carton 230 is shown in preparation for insertion of cigarette bundle 34 in FIG. 6. The cigarette packs 36 are positioned such that bottom ends 38 will lie adjacent panel/wall 216 when inside carton 230 so that ends 38 will be exposed through windows 215. A sealed, filled carton having lines 219 in panel 218 is shown in FIG. 7.

Figure 8:
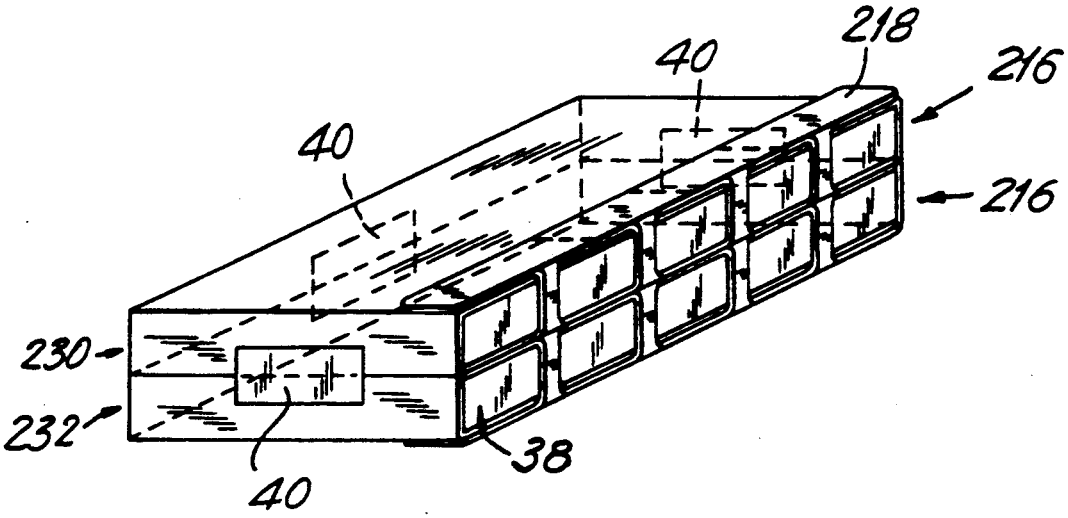
FIG. 8 is an isometric view of two five-pack cartons, each constructed from a blank similar to that shown in FIG. 5, connected together to form, once connected, a ten-pack carton.

As shown in FIG. 8, two cartons 230, 232, each formed by a blank such as blank 200, may be joined, by means such as described in above-incorporated patent application Ser. No. 07/774,529, such as stickers 40, applied across adjacent coplanar walls. Such a dual carton may be passed through commercially available tax-stamping machinery, and affords the same benefits as the dual carton of FIG. 4.

Figure 9:
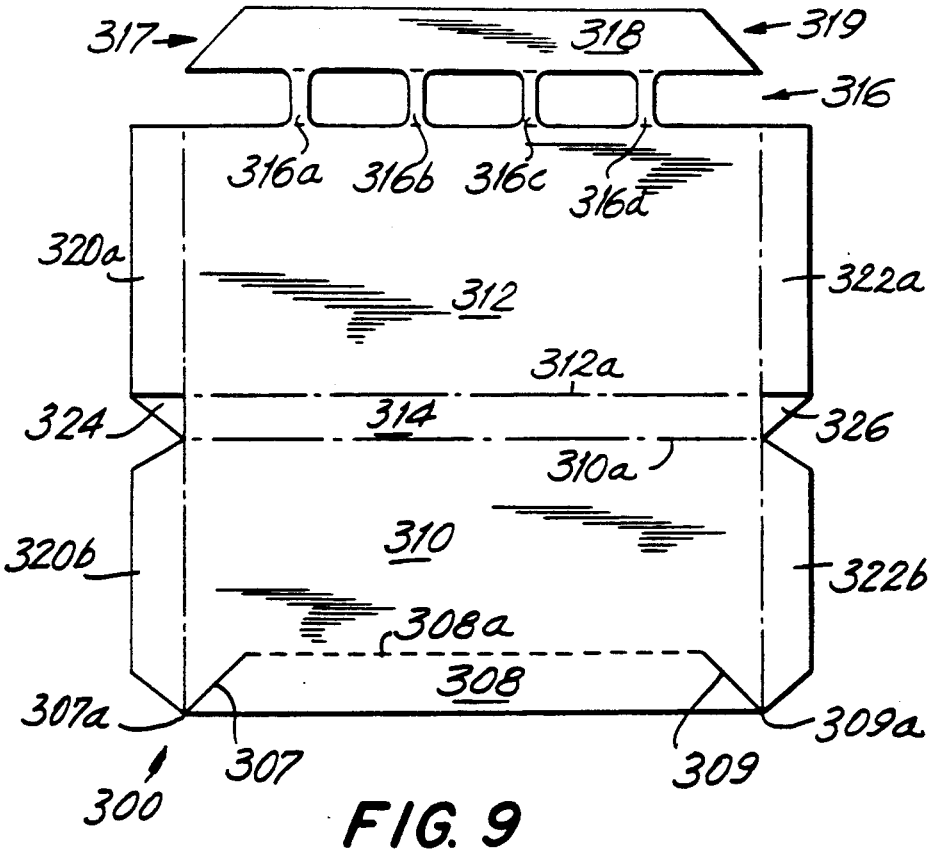
FIG. 9 is a plan view of an illustrative carton blank for a five-pack carton having windows in the covering flap, and a tear off section in the front wall, in accordance with this invention.

Blank 300, shown in FIG. 9, is substantially the same as blank 200 of FIG. 5 with some variations, as will be noted. Panels 310, 314, 312, 316, and 318 are front, bottom, rear, top, and extension panels, respectively. Panel 316 has a plurality of window sections 315, with web sections/connection strips 316*a*, 316*b*, 316*c*, and 316*d* extending between the windows and joining panels 312 and 318. Windows 315 and webs 316*a*, 316*b*, 316*c*, and 316*d* are dimensioned such as their counterparts in blank 100. Panels 320*a* and 320*b* form side wall 320, and panels 322*a* and 322*b* form side wall 322, when blank 300 is folded and formed into five-pack carton 330, along fold lines, represented by broken lines not all individually labeled. Dust flaps 324 and 326 are preferably folded perpendicular to bottom wall 314 and the cut edges preferably align with the cut edges of respective "b" panels 320*b* and 322*b*. Panels 320*a* and 322*a* preferably lie outside panels 320*b* and 322*b*.

Panel 310 of blank 300 includes section 308, defined by a line of weakness 308*a* (e.g. a score line or a line of perforations), and slits 307 and 309. Line 308*a* is preferably horizontal and slits 307 and 309 preferably are at an angle to line 308*a*, extending from near the corners of panel 310 towards the center of panel 310. These slits may begin at the edge of the blank, or may begin within the border of the blank, leaving connections 307*a* and 309*a*. Preferably, section 308 includes connections 307*a* and 309*a*, to prevent section 308 from leaving the plane of panel 310 during processing. The shape of extension panel 318 preferably corresponds to the shape of section 308. Panel 318 is secured to section 308 to form pull tab 328 composed of panels 318 and 308. A consumer can easily access pull tab 328 by inserting a finger into slit 307 or 309 to pull on tab 328, and remove tab 328 from panel 310 to open carton 330, leaving a cut out portion in panel 310. This cut out portion facilitates removal of the cigarette packs contained in the completed carton. The width of section 308 and extension panel 318 may be shortened, if desired, such that angled section 317 of panel 318, which corresponds to slit 307, may begin at web 316*a*, and angle towards the center of the panel, and angled section 319 of panel 318, which corresponds to slit 309, may begin at web 316*d*, and angle towards the center of the panel. Slits 307 and 309 would likewise be positioned closer to the center of panel 310.

Figure 10:
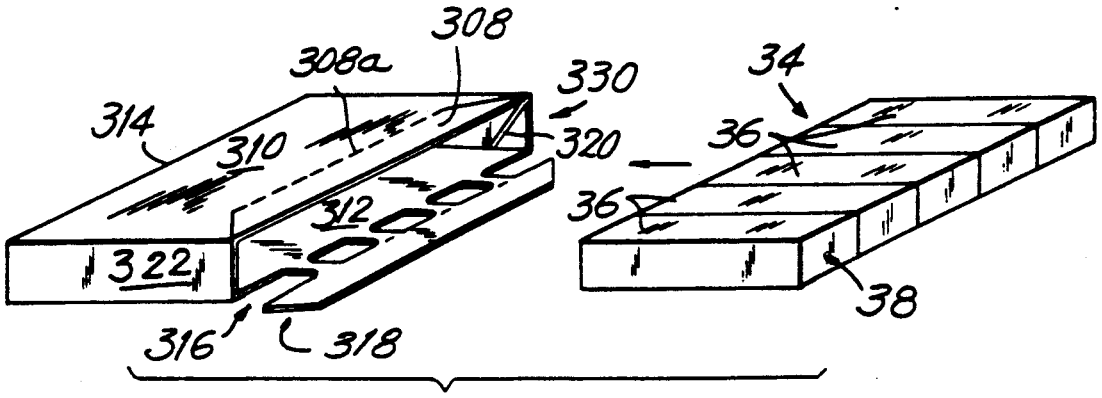
FIG. 10 is an exploded isometric view of a carton constructed from a blank similar to that shown in FIG. 9, illustrated prior to insertion of the cigarette packs into the carton.
Figure 11:
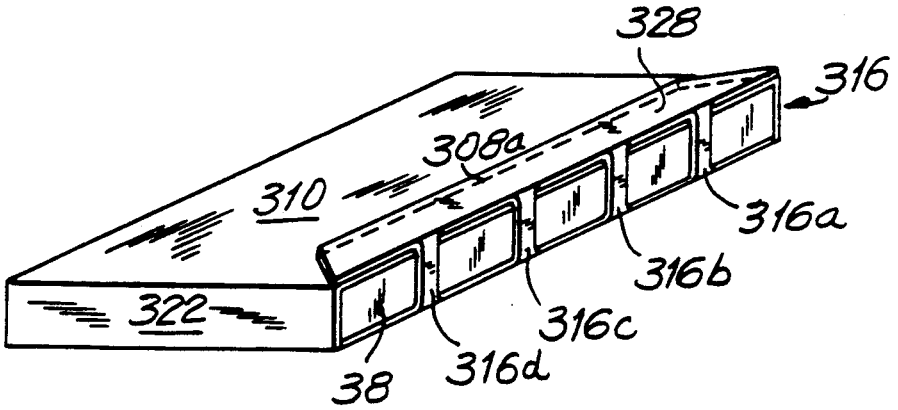
FIG. 11 is an isometric view of a sealed carton constructed from a blank similar to that shown in FIG. 9, and containing cigarette packs.

Completed carton 330 is shown in preparation for insertion of cigarette bundle 34 in FIG. 10. The cigarette packs 36 are positioned such that bottom ends 38 will lie adjacent panel/wall 316 when inside carton 330 so that ends 38 will be exposed through windows 315. The sealed, filled carton is shown in FIG. 11, which also shows completed pull tab 328.

Figure 12:
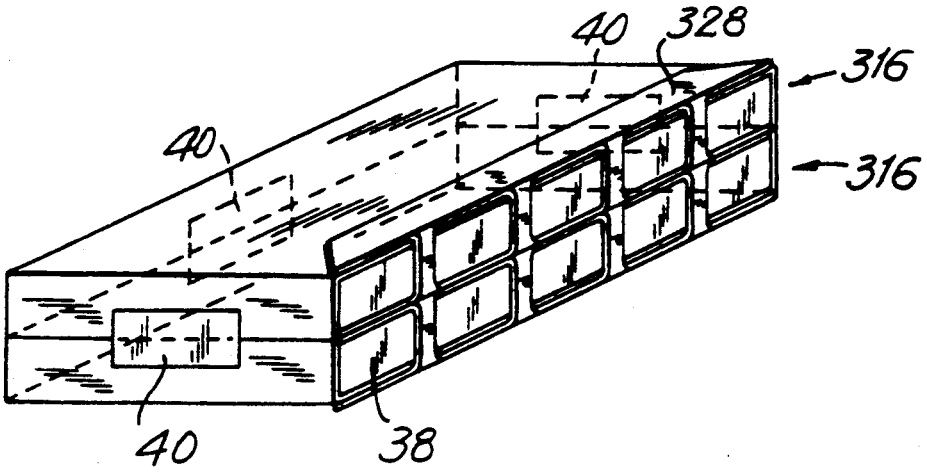
FIG. 12 is an isometric view of two five-pack cartons, each constructed from a blank similar to that shown in FIG. 9, connected together to form, once connected, a ten-pack carton.

As shown in FIG. 12, two cartons 330, 332, formed by a blank such as blank 300, may be joined, by means such as described in copending, commonly-assigned patent application Ser. No. 07/774,529, such as stickers 40, applied across adjacent coplanar walls. Such a dual carton may be passed through commercially available tax-stamping machinery, and affords the same benefits as the dual carton of FIG. 4.

Figure 13:
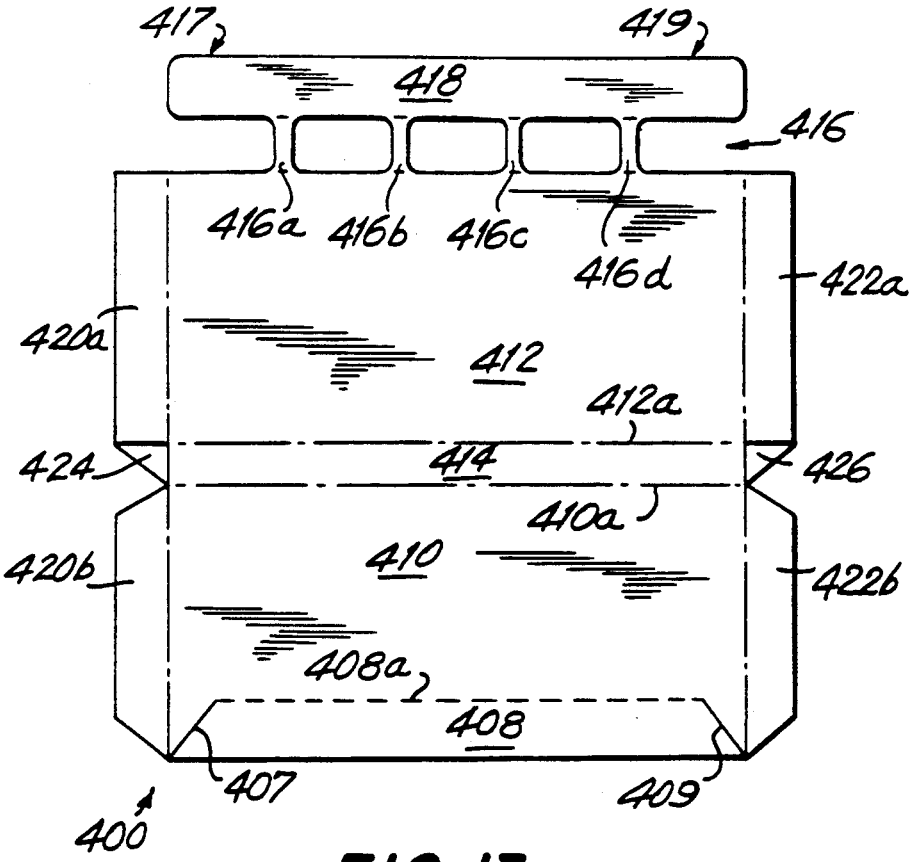
FIG. 13 is a plan view of an illustrative carton blank for a five-pack carton having windows in the covering flap, and a tear off section in the front wall revealing a pull tab, in accordance with this invention.

Blank 400, shown in FIG. 13, which is substantially the same as blank 300 of FIG. 9 has a modified pull tab. Similar to blank 300, corresponding panels 410, 414, 412, 416, and 418 of blank 400 are front, bottom, rear, top, and extension panels, respectively. Panel 416 has a plurality of window sections 415, with web sections/-connection strips 416*a*, 416*b*, 416*c*, and 416*d* extending between the windows and joining panels 412 and 418. Windows 415 and webs 416*a*, 416*b*, 416*c*, and 416*d* are dimensioned such as their counterparts in blank 100. Panels 420*a* and 420*b* form side wall 420, and panels 422*a* and 422*b* form side wall 422, when blank 400 is folded and formed into five-pack carton 430, along fold lines, represented by broken lines not all individually labeled. Dust flaps 424 and 426 are preferably folded perpendicular to bottom wall 414 and the cut edges preferably align with the cut edges of respective "b" panels 420*b* and 422*b*. Panels 420*b* and 422*b* preferably lie adjacent the interior of carton 430.

Panel 410 of blank 400 includes section 408, defined by a line of weakness 408*a* (e.g., a score line or a line of perforations), and slits 407 and 409. Section 408 is substantially the same shape as section 308, and slit 407 and 409 have substantially the same specifications as slits 307 and 309. Panel 418, which is substantially rectangular in shape, similar to panel 218, is preferably tucked into the completed carton, shown in FIG. 15, and secured with any permanent or releasably adhesive known in the art, to section 408 to form pull tab 428 composed of panels 418 and 408. Because section 408 is substantially trapezoidal, and panel 418 is substantially rectangular, sections 417 and 419 will extend beyond the borders of section 408. Section 417 and 419 are preferably extended through slits 407 and 409, respectively, when panel 418 is tucked inside the carton, so that sections 417 and 419 are visible while the remaining portion of panel 418 is hidden by section 408. These sections preferably bear indicia indicating that a consumer should pull on these sections to pull off pull tab 428 to remove tab 428 from panel 410 to open carton 430, leaving a cut out portion in panel 410. This cut out portion facilitates removal of the cigarette packs contained in the completed carton. The width of section 408 and extension panel 418 may be shortened, if desired, such that section 417 of panel 418 may begin closer to web 416*a*, and section 419 of panel 418 may begin closer to web 416*d*. Slits 407 and 409 would likewise be positioned closer to the center of panel 410. Sections 417 and 418 should be of sufficient length to extend beyond the border of section 408 to provide a pull section for pull tab 428.

Figure 14:
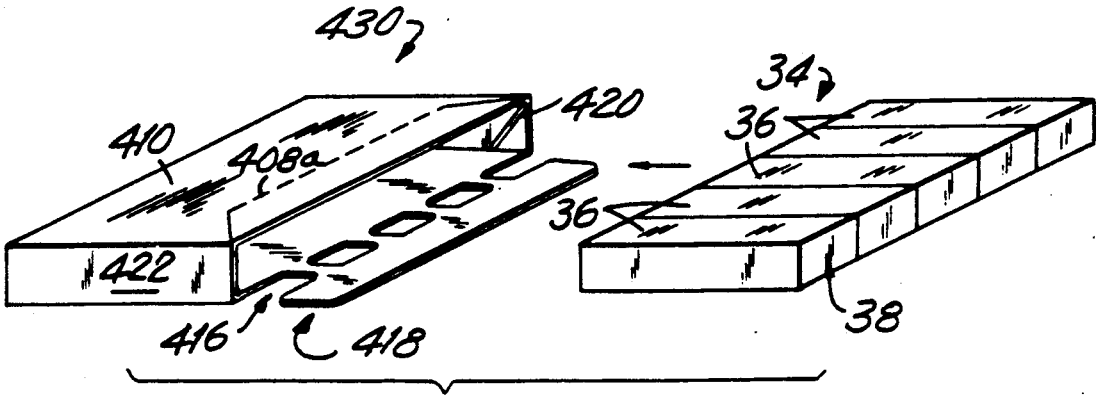
FIG. 14 is an exploded isometric view of a carton constructed from a blank similar to that shown in FIG. 13, illustrated prior to insertion of the cigarette packs into the carton.
Figure 15:
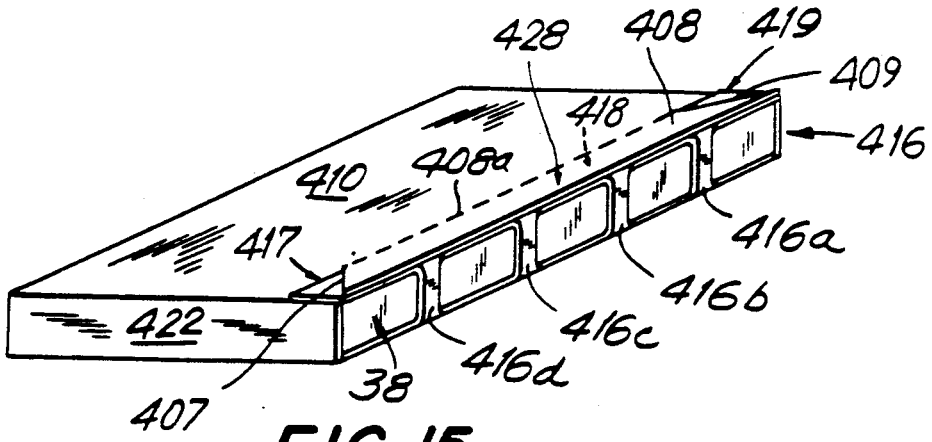
FIG. 15 is an isometric view of a sealed carton constructed from a blank similar to that shown in FIG. 13, and containing cigarette packs.

Completed carton 430 is shown in preparation for insertion of cigarette bundle 34 in FIG. 14. As previously described, the cigarette packs 36 are positioned such that bottom ends 38 will be exposed through windows 415. The sealed, filled carton is shown in FIG. 15, which also shows completed pull tab 428, with exposed sections 417 and 419.

Figure 16:
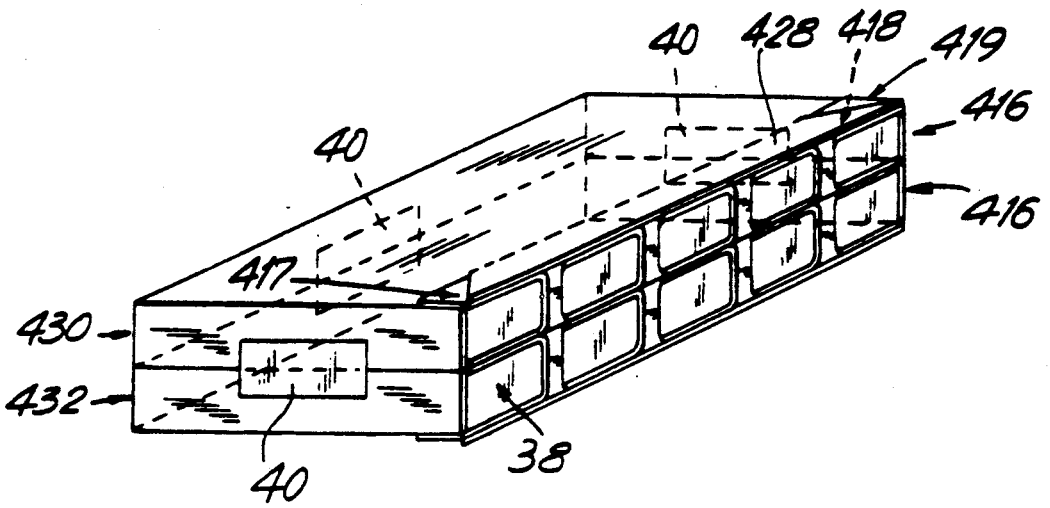
FIG. 16 is an isometric view of two five-pack cartons, each constructed from a blank similar to that shown in FIG. 13, connected together to form, once connected, a ten-pack carton.

As shown in FIG. 16, two cartons 430, 432, formed by a blank such as blank 400, may be joined, by means such as described in above-incorporated patent application Ser. No. 07/774,529, such as stickers 40, applied across adjacent coplanar walls, as described above, in reference to FIG. 4.

Figure 17:
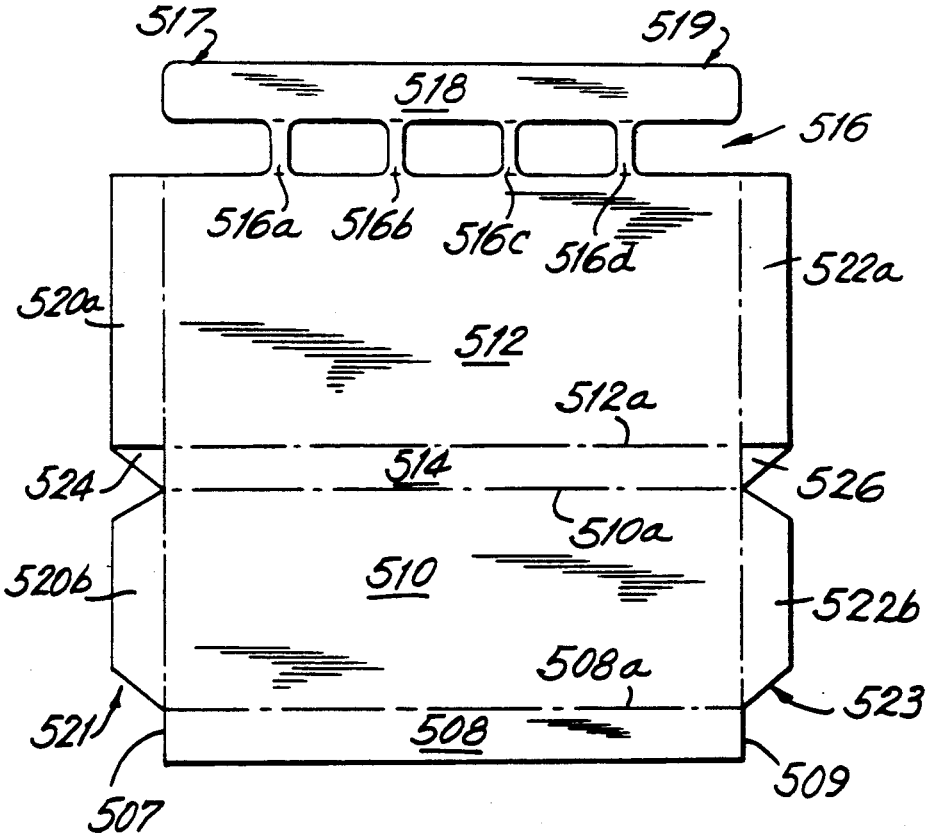
FIG. 17 is a plan view of an illustrative carton blank for a five-pack carton having windows in the covering flap, and a tear off section in the front wall, in accordance with this invention.

Blank 500, shown in FIG. 17, which is substantially the same as blank 200 of FIG. 5, has provisions for a pull tab, similar to pull tabs 328 and 428. Similar to blank 200, panels 510, 514, 512, 516, and 518 of blank 500 are front, bottom, rear, top, and extension panels, respectively. Panel 516 has a plurality of window sections 515, with web sections/connection strips 516*a*, 516*b*, 516*c*, and 516*d* extending between the windows and joining panels 512 and 518. Windows 515 and webs 516*a*, 516*b*, 516*c*, and 516*d* are dimensioned such as their counterparts in blank 100. Panels 520*a* and 520*b* form side wall 520, and panels 522*a* and 522*b* form side wall 522, when blank 500 folded and formed into five-pack carton 530, along fold lines, represented by broken lines not all individually labeled. Dust flaps 524 and 526 are preferably folded perpendicular to bottom wall 514 and the cut edges preferably align with the cut edges of respective "b" panels 520*b* and 522*b*. Panels 520*a* and 522*a* preferably are folded over panels 520*b* and 522*b*, respectively, so that the "a" panels lie adjacent the exterior of carton 530.

The "b" panels of side walls 520 and 522 further include cut edges 521 and 523, and do not extend the full height of the formed carton 530. Thus, section 508 of panel 510 extends above panel 510 without connection to either side wall 520 or 522 along edges 507 and 509. A line of weakness 508*a* (e.g., a score line or a line of perforations), is preferably provided along the border of section 508 and panel 510, i.e., extending between the joining point of edges 521 and 523 with panel 510 adjacent panel 508. Panel 518, which is preferably substantially rectangular in shape, similar to panel 218, is secured to section 508 with any permanent or releasably adhesive known in the art, to form pull tab 528 composed of panels 518 and 508. Because edges 507 and 509 are free from connections to the side walls, pull tab 528 is readily accessible by the consumer, to be pulled and removed from panel 510, leaving a cut out portion in panel 510. This cut out portion facilitates removal of the cigarette packs contained in the completed carton. The width of extension panel 518 may be shortened, if desired, such that section 517 of panel 518 may begin closer to web 516*a*, and section 519 of panel 518 may begin closer to web 516*d*, to reduce material costs.

Figure 18:
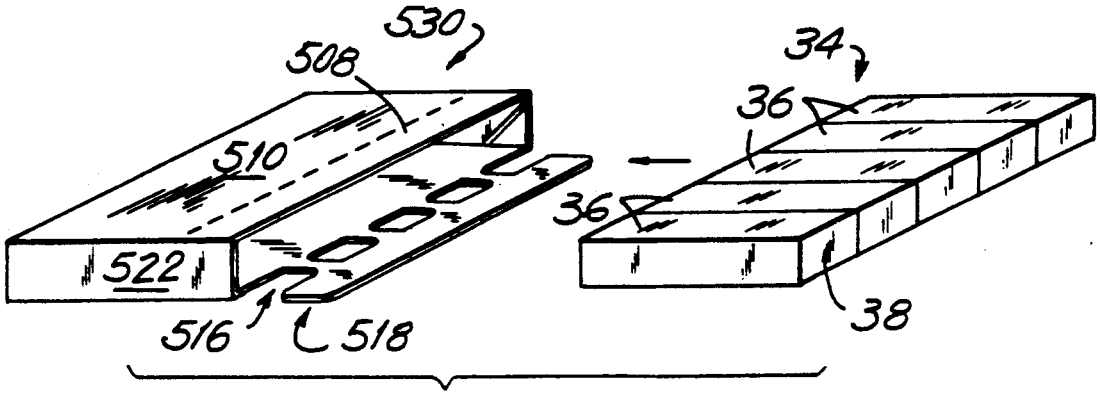
FIG. 18 is an exploded isometric view of a carton constructed from a blank similar to that shown in FIG. 17, illustrated prior to insertion of the cigarette packs into the carton.
Figure 19:
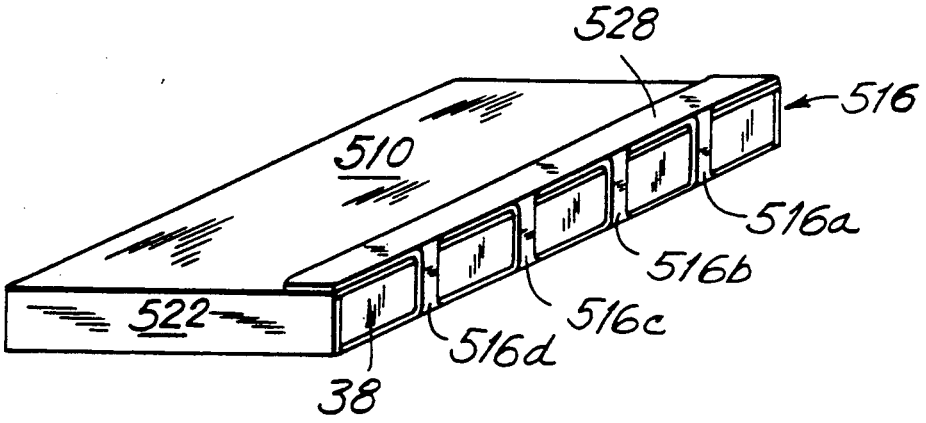
FIG. 19 is an isometric view of a sealed carton constructed from a blank similar to that shown in FIG. 17, and containing cigarette packs.

Completed carton 530 is shown in preparation for insertion of cigarette bundle 34 in FIG. 18. As previously described, the cigarette packs 36 are positioned such that bottom ends 38 will be exposed through windows 515. The sealed, filled carton is shown in FIG. 19.

Figure 20:
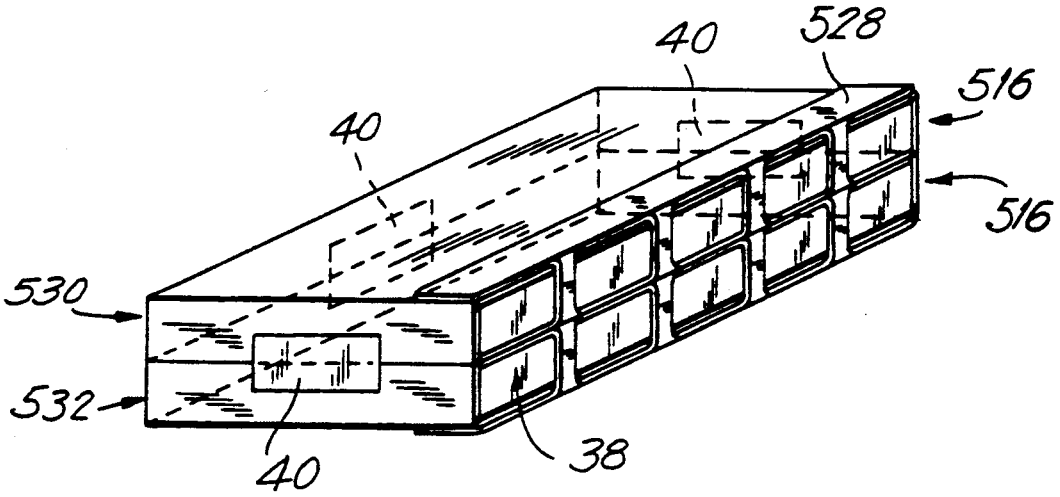
FIG. 20 is an isometric view of two five-pack cartons, each constructed from a blank similar to that shown in FIG. 17, connected together to form, once connected, a ten-pack carton.

As shown in FIG. 20, two cartons 530, 532, formed by a blank such as blank 500, may be joined, by means such as described in above-incorporated patent application Ser. No. 07/774,529, such as stickers 40, applied across adjacent coplanar walls, as described above, in reference to FIG. 4.

It will be appreciated that the directional references "top", "bottom", "front", and "rear" do not limit the respective panels to such orientation, but merely serve to distinguish these panels from one another. Hence, for example, panel 214, which is referred to as a bottom panel, may be positioned at the top of the carton, i.e., the tops of the cigarette packs contained in the carton will be positioned adjacent panel 214.

Although cut out portions are only shown in one of the top and bottom panels, cut out portions may be located in both the top panel and the bottom panel of any or all of blanks 100, 200, 300, 400, 500.

Although weakened line 110*a* is only shown in blank 100, such a line may be included in any or all of blanks 200, 300, 400, or 500, between the web portions of the blanks and the walls which the web portions connect.

Although the blanks herein described are used to form five-pack cartons, in which one row of five cigarette packs is placed, these blanks may be dimensioned to form cartons dimensioned to contain more than one row of cigarette packs. Hence, for example, a ten-pack carton having two rows of five cigarette packs per row, i.e., five columns of two cigarette packs per column, is within the scope of the invention. Likewise, these blanks may be dimensioned to contain fewer or more than five columns of cigarette packs, with sufficient windows to expose an end of each of the packs contained therein.

Although the disclosed blanks form substantially rectangular cigarette cartons, additional score lines, or other means, may be added so that the blanks may be folded to form cartons with rounded edges, or cartons of other configurations. Likewise, it will be appreciated that references to cigarette packs are not limited to only rectangular packs, but include such packs as oval packs, packs with rounded edges, and other non-rectangular shapes.

Although pull tabs 328, 428, and 528 are described as having specific shapes, any desirable shape which would accomplish the function of these pull tabs is contemplated.

It will be appreciated that references to tax-stamping machinery are intended to include any existing equipment which is readily available to distributors, and modified versions.

Although the dual cartons disclosed in the Figures are shown with their respective extension flaps facing outwardly, i.e., the individual cartons are positioned with their rear walls facing one another, the cartons may alternatively be positioned with their extension flaps facing inwardly, i.e., the individual cartons may be positioned with their front wall facing one another.

It will be appreciated that any or all of the disclosed extension flaps may be tucked inside the carton or secured to the outer surface of the front wall.

Although the extension panels of the disclosed blanks are shown as extending the full width of their respective cartons, the extension panels may be shortened such that they extend only along a central portion of the carton, preferably a sufficient length to retain the cigarette packs securely in the cartons.

It will be understood that the foregoing is merely illustrative of the principles of the invention, and that various modifications can be made by those skilled in the art without departing from the scope and spirit of the invention. The present embodiments are described for the purpose of illustration rather than limitation, and the present invention is limited only by the claims which follow.

What is claimed is:

1. A cigarette carton for packaging cigarette packs, said carton comprising:

a front wall having a top edge, a bottom edge, and two side edges;

a rear wall, spaced from said front wall, and having a top edge, a bottom edge, and two side edges;

first and second side walls connecting juxtaposed side edges of said front wall and said rear wall;

a first extension panel formed along said top edge of said rear wall for folding across the top of said carton to form a top wall, wherein said first extension panel has a free edge which lies adjacent said top edge of said front wall when said first extension panel is folded over the top of said carton;

a bottom wall extending from said bottom edge of said front wall to said bottom edge of said rear wall;

a second extension panel formed along said free edge of said first extension panel for securing to said front wall to close said carton;

at least one line of weakness substantially perpendicular to said free edge of said first extension panel and extending across the height of said second extension panel to define a portion of said second extension panel to be detached from said front wall when said carton is sealed, to access a portion of said cigarette packs contained within said carton; and access means provided along said first extension panel and cooperating with said at least one line of weakness such that a portion of said first extension panel may be lifted when said portion of said second extension panel is detached to access said cigarette packs.

2. The cigarette carton of claim 1 wherein:

said first extension panel has a plurality of cut out portions and a connection strip between each adjacent pair of cut out portions such that said first extension panel includes at least one connection strip and the endmost cut out portions have a connection strip on only one side;

said access means is defined by said cut out portions and said connection strip between each adjacent pair of cut out portions, such that when said at least one line of weakness is torn, the tear thereby formed cooperates with one of said cut out portion and said connection strip to free an adjacent portion of said top wall from above the cigarette packs contained within said carton when said carton is sealed;

said cut out portions are located and dimensioned such that an end of each of said cigarette packs which is to be contained in said carton is sufficiently exposed when said first extension panel is folded over the top of said carton so that a valid portion of a tax stamp may be applied to said end of each said cigarette pack; and said at least one connection strip has a first end adjacent said rear wall and a second end adjacent said extension panel and is of sufficient width and is positioned such that said strip lies across the edges of adjacent cigarette packs to retain said packs within said carton when said first extension panel is folded over the top of said carton.

3. The cigarette carton of claim 2 wherein said at least one line of weakness ends at one of said cut out portions of said first extension panel.

4. The cigarette carton of claim 2 wherein said carton is dimensioned for packaging at least one row of cigarette packs and at least three columns of cigarette packs, each said cigarette pack having a pair of front and rear long walls and a pair of opposed short walls;

said packs are arranged in each said row with said front walls aligned to form first and second spaced apart substantially parallel planes in which said front walls and said rear walls, respectively, lie, and said packs are arranged in each said column with said front walls of said packs arranged in successive substantially parallel spaced apart planes with said opposed short walls aligned to form a pair of spaced apart parallel planes.

5. The cigarette carton of claim 4 wherein said at least one connection strip includes one less connection strip than the number of columns contained in said carton such that said at least one connection strips includes at least two connection strips.

6. The cigarette carton of claim 5 wherein said at least one line of weakness ends at a cut out portion and between two connection strips.

7. The cigarette carton of claim 5 wherein:

said at least one line of weakness is substantially collinear with, and ends at, a common edge of (a) one of said connection strips, and (b) a cut out portion adjacent to said one of said connection strips; and said cut out portion adjacent to said one of said connection strips has a connection strip on both sides thereof.

8. The cigarette carton of claim 5 wherein said at least one line of weakness comprises a line of weakness corresponding to each cut out portion that has a connection strip on both sides thereof.

9. The cigarette carton of claim 2 further including a second line of weakness between said at least one connection strip and said second extension panel.

10. The cigarette carton of claim 2 further including a second line of weakness between said at least one connection strip and said rear wall.

11. The cigarette carton of claim 2 further comprising:

a second carton substantially identical to said carton, and having corresponding front, rear, bottom, and side walls, and corresponding first and second extension panels, said second carton positioned adjacent said cigarette carton with one of said front and rear walls of said carton coextensive with one of said front and rear walls of said second carton; and means for joining said cartons to form a dual carton.

12. The cigarette carton of claim 1 wherein said access means comprises a second line of weakness meeting and aligned with said first line of weakness, said second line of weakness substantially perpendicular to said free edge of said first extension panel and extending across said first extension panel.

13. The cigarette carton of claim 1 wherein:

said carton is dimensioned for packaging a first number of rows of cigarette packs and a second number of columns of cigarette packs, each said cigarette pack having a pair of front and rear long walls and a pair of opposed short walls;

said packs are arranged in each said row with said front and rear long walls aligned to form first and second spaced apart substantially parallel planes in which said front long walls and said rear long walls, respectively, lie;

said packs are arranged in each said column with said front long walls of said packs arranged in successive substantially parallel spaced apart planes and with said opposed short walls aligned to form a pair of spaced apart parallel planes; and said at least one line of weakness comprises sufficient lines of weakness to form a number of said portions of said second extension panel formed by said lines of weakness to allow access to one column of cigarette packs at a time upon subsequent detachment of each said portion of said second extension panel when said carton is sealed.

14. The cigarette carton of claim 13 wherein:

said front and rear walls are of sufficient width for said carton to contain said second number of columns of said cigarette packs; and said planes of said front and rear long walls of said cigarette packs are substantially parallel said front wall of said carton.

15. The cigarette carton of claim 14 wherein said rear wall is substantially the same dimension as said front wall.

16. The cigarette carton of claim 14 wherein said second number of columns is five.

17. The cigarette carton of claim 13 wherein:

said side walls are of sufficient width for said carton to contain said first number of rows of said cigarette packs; and said short walls of said packs are substantially parallel said side walls of said carton.

18. The cigarette carton of claim 17 wherein said at least one of said side walls are substantially the same dimension.

19. The cigarette carton of claim 17 wherein said first number of rows is one.

20. The cigarette carton of claim 1 wherein said rear wall is substantially the same dimension as said front wall.

21. The cigarette carton of claim 1 wherein said second extension panel is secured to said front wall to seal said carton.

22. The cigarette carton of claim 21 wherein said extension panel is secured with releasable adhesive to the outside of said carton.

23. The cigarette carton of claim 1 further comprising:

a second carton substantially identical to said carton, and having corresponding front, rear, bottom, and side walls, and corresponding first and second extension panels, and positioned adjacent said cigarette carton with one of said front and rear walls of said carton coextensive with one of said front and rear walls of said second carton; and means for joining said cartons to form a dual carton.

24. A cigarette carton for packaging cigarette packs, each said cigarette pack having a pair of opposed long walls and a pair of opposed short walls, said carton comprising:

a front wall having a top edge, a bottom edge, and two side edges;

a rear wall, spaced from said front wall, and having a top edge, a bottom edge, and two side edges;

first and second side walls connecting juxtaposed side edges of said front wall and said rear wall;

a first extension panel along said top edge of said rear wall, for folding across the top of said carton toward said top edge of said front wall to form a top wall, wherein said first extension panel has a free edge which lies adjacent said top edge of said front wall when said first extension panel is folded over the top of said carton;

a bottom wall having a front edge adjacent said bottom edge of said front wall, a rear edge adjacent said bottom edge of said rear wall, and two side edges, wherein said bottom wall extends between said front wall and said rear wall;

a section defined in said front wall by a first line of weakness having two ends and by two slits, wherein said line of weakness is spaced from said top edge of said front wall and extends across the width of said front wall, and each said slit extends from an end of said line of weakness toward the top edge of said front wall; and a second extension panel formed along said free edge of said first extension panel for securing to said section defined in said front wall to form a pull tab comprised of said extension panel and said top wall;

wherein each said slit provides access to said pull tab formed when said extension panel is secured to said section so that said pull tab may be pulled from said carton to open said carton.

25. The cigarette carton of claim 24 further including:

a second carton substantially identical to said carton, and having corresponding front, rear, bottom, and side walls, and corresponding first and second extension panels, said second carton positioned adjacent said carton with one of said front and rear walls of said carton coextensive with one of said front and rear walls of said second carton; and means for joining said cartons to form a dual carton.

26. The cigarette carton of claim 24 wherein said first line of weakness facilitates removal of said section to leave a cut out section in said front wall to facilitate removal of cigarette packs contained in said carton.

27. The cigarette carton of claim 24 wherein said first line of weakness comprises a line of perforations.

28. The cigarette carton of claim 24 wherein said first line of weakness comprises a score line.

29. The cigarette carton of claim 24 further including a second line of weakness extending along said free edge of said first extension panel between said first extension panel and said second extension panel.

30. The cigarette carton of claim 29 wherein said second line of weakness comprises a line of perforations.

31. The cigarette carton of claim 24 wherein:

said first extension panel further includes a plurality of cut out portions and a connection strip between each adjacent pair of cut out portions such that said first extension panel includes at least one connection strip;

said cut out portions are located and dimensioned such that an end of each of said cigarette packs which are to be contained in said carton may be sufficiently exposed when said first extension panel is folded over the top of said carton so that a valid portion of a tax stamp may be applied to said end of each said cigarette pack; and said at least one connection strip has a first end adjacent said rear wall and a second end adjacent said second extension panel and is of sufficient width and is positioned such that when said carton is filled with cigarette packs and closed, said strips lie across the edges of adjacent cigarette packs to retain said packs within said carton.

32. The cigarette carton of claim 31 further including a second line of weakness between said at least one connection strip and said second extension panel to facilitate removal of said second extension panel from said first extension panel, wherein said first line of weakness, said slits and said second line of weakness cooperate to facilitate removal of said pull tab from said front wall of said carton.

33. The cigarette carton of claim 31 further including:

a second carton substantially identical to said carton and having corresponding front, rear, bottom, and side walls, and corresponding first and second extension panels, said second carton positioned adjacent said carton with one of said front and rear walls of said carton coextensive with one of said front and rear walls of said second carton; and means for joining said cartons to form a dual carton.

34. The cigarette carton of claim 24 wherein said second extension panel is secured to said section in said front wall.

35. The cigarette carton of claim 34 wherein said second extension panel is secured to said section with permanent adhesive.

36. The cigarette carton of claim 34 wherein said second extension panel is tucked inside said carton and secured to the inside of said section of said front wall so that when said carton is filled with cigarette packs, said second extension panel is positioned between said carton and said cigarette packs.

37. The cigarette carton of claim 24 wherein each said slit ends before reaching said top edge of said front wall so that said section is secured to said front wall and remains in the plane of said front wall.

38. The cigarette carton of claim 24 wherein the shape of said second extension panel is substantially the same as the shape of said section such that the borders of said second extension panel and said section are coextensive when said extension panel is secured to said section to thereby form a pull tab.

39. The cigarette carton of claim 24 wherein:

each said slit is positioned at an angle to said top edge of said front wall; and each said slit extends from near the corner of said top edge and said side edge toward the center of said front wall, such that said section is substantially trapezoidal in shape.

40. The cigarette carton of claim 39 wherein the shape of said second extension panel is substantially the same as the shape of said section such that the borders of said second extension panel and said section are coextensive when said second extension panel is secured to said section to thereby form a pull tab.

41. The cigarette carton of claim 39 wherein:

said second extension panel is substantially rectangular in shape;

said second extension panel is tucked inside said carton; and the bottom corners of said second extension panel extend outside said carton beyond said slits such that said bottom corners of said second extension panel lie adjacent the outside of said carton, free from connection to said front wall.

42. The cigarette carton of claim 41 wherein:

said second extension panel and said section form a pull tab; and at least one of said bottom corners of said second extension panel further includes indicia indicating the use of said at least one bottom corner for pulling on said pull tab to remove said pull tab from said carton.

43. The cigarette carton of claim 42 wherein removal of said pull tab leaves a cut out section in said front wall to facilitate removal of said cigarette packs to be contained within said carton.

44. The cigarette carton of claim 41 wherein said second extension panel is secured to said section.

45. The cigarette carton of claim 39 wherein each said slit ends before reaching said corner such that said slit is positioned within the boundaries of said front wall.

46. The cigarette carton of claim 39 wherein said first line of weakness comprises a line of perforations.

47. The cigarette carton of claim 39 wherein said first line of weakness comprises a score line.

48. The cigarette carton of claim 39 wherein said second extension panel is tucked inside said carton and secured to the inside of said section of said front wall so that when said carton is filled with cigarette packs, said second extension is positioned between said carton and said cigarette packs.

49. The cigarette carton of claim 24 wherein:

each said side wall is formed from a first side panel extending from said side edge of said front wall, and a second side panel extending from said side edge of said rear wall; and said side panels are secured together to form said side walls.

50. The cigarette carton of claim 49 wherein:

each said first side panel has a top edge and a bottom edge and extends partially across said side edge of said front wall such that said top edge of said first side panel is spaced below said top edge of said front wall thereby leaving a free corner at the top of said front wall from which said first panel does not extend;

each said second side panel has a top edge and a bottom edge and extends across the length of said side edge of said rear wall such that said top edge of said second side panel is aligned with said top edge of said rear wall and said bottom edge of said second side panel is aligned with said bottom edge of said rear wall;

each said side wall is formed with said first side panel adjacent the interior of said carton and said second side panel adjacent the exterior of said carton such that said second side panel is joined to said front wall by means of said first side panel and is free from connection to said front wall at said corner; and each said slit is formed between said front wall and each said side wall at each said free corner.

51. The cigarette carton of claim 24 further including a dust flap extending from each said side edge of said bottom wall.

52. The cigarette carton of claim 51 wherein each said dust flap is positioned substantially perpendicular to said bottom wall and substantially parallel to said side walls inside said carton.

53. The cigarette carton of claim 52 wherein:

each said side wall is formed from a first side panel having a top edge and a bottom edge and extending from said side edge of said front wall, and a second side panel having a top edge and a bottom edge and extending from said side edge of said rear wall; and said side panels are secured together to form said side walls.

54. The cigarette carton of claim 53 wherein:

each of said dust flaps is substantially shaped as a right triangle, the hypotenuse of which is positioned adjacent one of said first and second side panels; and the bottom edge of said one of said first and second side panels is cut at approximately a 45° angle to correspond to said hypotenuse and said one of said first and second side panels is positioned adjacent the interior of said carton such that said one of said first and second side panels and said dust flap lie in the same plane with said bottom edge of said one of said first and second side panels adjacent said hypotenuse.

55. The cigarette carton of claim 24 wherein said rear wall is substantially parallel said front wall.

56. The cigarette carton of claim 24 wherein said rear wall is substantially the same dimension as said front wall.

57. A dual cigarette carton of dimensions compatible with tax-stamping machinery used in the automated processing of cigarette cartons, each said cigarette pack having a pair of opposed long walls and a pair of opposed short walls, said dual carton comprising:

first and second cartons each having a pair of opposed long walls, a pair of opposed short walls, a top wall, and a bottom wall, wherein at least one of said top wall and said bottom wall further includes at least one cut out portion;

wherein said first and second cartons are positioned adjacent one another with one of said long walls of said first carton coextensive with one of said long walls of said second carton such that the borders of said coextensive long walls are aligned;

means for securing said first carton to said second carton to form said dual carton;

wherein said at least one cut out portion is located and dimensioned such that an end of a cigarette pack which is to be contained in said carton is sufficiently exposed to apply a valid portion of a tax stamp to said end of said cigarette pack.

58. The dual cigarette carton of claim 57 wherein said at least one cut out portion comprises a plurality of cut out portions.

59. The dual cigarette carton of claim 58 further comprising a connection strip between each adjacent pair of cut out portions such that said at least one of said top wall and said bottom wall includes at least one connection strip; wherein:

said at least one connection strip has a first end adjacent one of said pair of long walls and a second end adjacent the other of said pair of long walls; and said at least one connection strip is of sufficient width and is positioned such that when said carton is filled with cigarette packs and closed, said strip lies across the edges of adjacent cigarette packs to retain said packs within said carton.

60. The dual cigarette carton of claim 59 further including a line of perforations extending between said first end of said at least one connection strip and one of said pair of long walls.

61. The dual cigarette carton of claim 60 further including a line of perforations extending between said second end of said at least one connection strip and the other of said pair of long walls.

62. The dual cigarette carton of claim 59 wherein:

said top wall is formed from a first extension panel extending from one of said long walls of said cigarette carton; and each said cigarette carton further includes a second extension panel extending from said first extension panel for securing said at least one connection strip across the top of said carton to retain cigarette packs within said carton.

63. The dual cigarette carton of claim 62 wherein:

said at least one connection strip comprises a plurality of connection strips spaced from one another and each substantially parallel the plane of said short walls, defining a pair of outermost connection strips spaced from said pair of short walls of said cigarette carton with a cut out portion between each said outermost connection strip and said short wall; and said second extension panel has first and second ends and extends between said pair of outermost connection strips such that said first and second ends are spaced from said short walls of said cigarette carton.

64. The dual cigarette carton of claim 57 wherein:

the width of each said short wall of said cartons is at least as wide as the width of each said short wall of said cigarette pack such that a cigarette pack can be positioned inside said carton with said short wall of said cigarette pack parallel said short wall of said cigarette carton; and each of said first and second cartons is dimensioned to contain at least one cigarette pack said first and second cartons positioned such that a first of said pair of short walls of each said cigarette pack lies in a first plane and a second of said pair of short walls of each said cigarette pack lies in a second plane spaced apart from and substantially parallel to said first plane.

65. The dual cigarette carton of claim 64 wherein each of said long walls of said cartons is at least as wide as five times the width of said long wall of said cigarette pack, such that said dual carton is dimensioned to contain ten cigarette packs arranged adjacent one another with said long walls of said cigarette packs substantially parallel said long walls of each of said cartons and with said short walls of said cigarette packs substantially parallel said short walls of each of said cartons.

66. The dual cigarette carton of claim 57 wherein:

said top wall is formed from an extension panel extending from one of said long walls of said cigarette carton; and said at least one cut out portion is located in said bottom wall.

67. The dual cigarette carton of claim 57 wherein:

said top wall is formed from a first extension panel extending from one of said long walls of said cigarette carton; and said at least one cut out portion is located in said first extension panel.

68. The dual cigarette carton of claim 67 further including a second extension panel extending from said first extension panel.

* * * * *